US006474367B1

(12) United States Patent
Jayaraman et al.

(10) Patent No.: US 6,474,367 B1
(45) Date of Patent: Nov. 5, 2002

(54) FULL-FASHIONED GARMENT IN A FABRIC AND OPTIONALLY HAVING INTELLIGENCE CAPABILITY

(75) Inventors: Sundaresan Jayaraman, Atlanta; Sungmee Park, Tucker, both of GA (US)

(73) Assignee: Georgia Tech Research Corp., Atlanta, GA (US)

( * ) Notice: Subject to any disclaimer, the term of this patent is extended or adjusted under 35 U.S.C. 154(b) by 53 days.

(21) Appl. No.: 09/713,160

(22) Filed: Nov. 14, 2000

Related U.S. Application Data

(63) Continuation-in-part of application No. 09/157,607, filed on Sep. 21, 1998, now Pat. No. 6,145,551, which is a continuation-in-part of application No. 09/273,175, filed on Mar. 19, 1999.

(51) Int. Cl.[7] ..... D03D 23/00; D03D 25/00

(52) U.S. Cl. ..... 139/383 R; 139/387 R; 66/171; 2/402; 2/227; 2/229

(58) Field of Search ..... 66/171; 112/470.05, 112/470.06, 470.16; 2/402, 227, 229; 139/383 R, 387 R

(56) References Cited

U.S. PATENT DOCUMENTS

| | | | | |
|---|---|---|---|---|
| 2,579,383 A | | 12/1951 | Goudsmit | |
| 2,935,096 A | | 5/1960 | Cole | |
| 3,020,935 A | | 2/1962 | Balis | |
| 3,409,007 A | | 11/1968 | Fuller | |
| 4,299,878 A | | 11/1981 | Rheaume | |
| 4,572,197 A | | 2/1986 | Moore et al. | |
| 4,580,572 A | | 4/1986 | Granek et al. | |
| 4,606,968 A | | 8/1986 | Thornton et al. | |
| 4,635,301 A | * | 1/1987 | Sulser | 2/105 |
| 4,649,573 A | * | 3/1987 | Yen | 2/108 |
| 4,668,545 A | | 5/1987 | Lowe | |
| 4,727,603 A | | 3/1988 | Howard | |
| 4,852,187 A | * | 8/1989 | Johansson | 2/102 |
| 4,956,879 A | * | 9/1990 | Adams | 112/475.09 |
| 5,103,504 A | | 4/1992 | Dordevic | |
| 5,212,379 A | | 5/1993 | Nafarrate et al. | |
| 5,316,830 A | | 5/1994 | Adams, Jr. et al. | |
| 5,415,204 A | | 5/1995 | Kitamura | |
| 5,436,444 A | | 7/1995 | Rawson | |
| 5,592,977 A | | 1/1997 | Kikuchi et al. | |
| 5,624,736 A | | 4/1997 | DeAngelis et al. | |
| 5,636,378 A | | 6/1997 | Griffith | |
| 5,694,645 A | | 12/1997 | Triplette | |
| 6,250,115 B1 | * | 6/2001 | Suzuki | 66/169 R |

* cited by examiner

*Primary Examiner*—Andy Falik
*Assistant Examiner*—Robert Muromoto, Jr.
(74) *Attorney, Agent, or Firm*—Todd Deveau; Jacqueline Haley; Troutman Sanders LLP

(57) ABSTRACT

The present invention is directed to a process for the production of a single-piece woven garment which can be converted into a full-body garment, similar to an overall or a hospital gown, using a minimum number of seams and a minimum amount of cutting. The garment is made a two-dimensional fabric, with the various parts produced as a single piece. Additionally, the garment can include an integrated infrastructure component for collecting, processing, transmitting and receiving information, giving it intelligence capability.

10 Claims, 5 Drawing Sheets

Layout of the Various Garment Parts in a Two Dimensional Fabric

Legend

| | |
|---|---|
| ·····—·· | Folding Line |
| ——— | Cutting Line |
| ✱ ☆ ⬢ ○ △ ◇ ▯ | Symbols for Joining and Stitching two Lines |
| LL | Left Leg |
| RL | Right Leg |
| FB | Front Body |
| BB | Back Body |
| LS | Left Sleeve |
| RS | Right Sleeve |

Figure 1. Garment in the Fabric

Figure 2. Layout of the Various Garment Parts in a Two Dimensional Fabric

Fig 3. Drawing-In-Draft

Figure 4. Lifting Plan

FULL-FASHIONED GARMENT IN A FABRIC AND OPTIONALLY HAVING INTELLIGENCE CAPABILITY

This application is a continuation-in-part of U.S. Ser. No. 09/157,607, filed on Sep. 21, 1998, now U.S. Pat. No. 6,145,551, and is a continuation-in-part of U.S. Ser. No. 09/273,175, filed on Mar. 19, 1999.

BACKGROUND OF THE INVENTION

1. Field of the Invention

The present invention relates to a process for the production of a single-piece woven garment which can be converted into a full-body garment, similar to an overall or a hospital gown, using a minimum number of seams and/or a minimum amount of cutting. The garment is made from a single two-dimensional fabric, with the various parts produced as a single piece. Additionally, the garment can include an integrated infrastructure component for collecting, processing, transmitting and receiving information, giving it intelligence capability.

2. Background of the Art

Conventional techniques for fashioning garments include using a pattern to form pieces of the garment, followed by cutting and sewing these pattern pieces to create a garment. The seams of conventionally-constructed garments may bind the wearer, causing discomfort and agitation. This invention reduces the number of operations involved in creating a garment. Moreover, it provides a means for inserting one or more yarns continuously throughout the fabric without any discontinuities encountered in traditional weaving.

Co-pending application U.S. Ser. No. 09/157,607, filed on Sep. 21, 1998, now U.S. Pat. No. 6,145,551 to Jayaraman, et al., discloses a full-fashioned weaving process for the production of a woven garment having armholes. The garment is a single integrated piece in which there are no discontinuities or seams, and the armholes result from the weaving process itself, not from cutting or sewing. However, the garment produced by the Jayaraman process does not include sleeves or legs, merely openings for the same.

A need therefore exists for a process to produce a full-fashioned, one piece, garment with sleeves and legs which minimizes the need for cutting and sewing fabric parts to fashion the garment. It is such a process and product to which the present invention is primarily directed. When the cutting and sewing process of the present invention is employed, the steps of cutting and sewing side seams for sleeves and legs are minimized.

Co-pending application U.S. Ser. No. 09/273,175, filed on Mar. 19, 1999, and also U.S. Ser. No. 09/157,607, filed on Sep. 21, 1998, both by Jayaraman et al., disclose a fabric or garment which includes an integrated infrastructure component for collecting, processing, transmitting and receiving information. The garment functions as a "wearable motherboard," which, by utilizing the interconnection of conductive fibers, integrates many data-collecting sensors into the garment without the need for multiple stand alone wires or cables. The information obtained may be transmitted to several monitoring devices through a single electronic lead or transceiver.

Utilizing the process of the present invention and the interconnection of electrical conductive fibers, optical fibers, or both, of the co-pending Jayaraman applications, it is possible to produce a one-piece garment with sleeves and legs, similar to an overall, which incorporates an integrated infrastructure component for collecting, processing, transmitting and receiving information.

SUMMARY OF THE INVENTION

It is, therefore, an object of the present invention to provide a one-piece garment with legs, and optionally with sleeves, which garment is comprised of only a single integrated piece of woven, knitted or nonwoven fabric and seams.

It is a further object of the present invention to provide a process to produce a one-piece, garment with legs, and optionally with sleeves, which garment is comprised of only a single integrated piece and seams.

It is a further object of the present invention to provide a one-piece garment with legs, and optionally with sleeves, which can include intelligence capability, such as the ability to monitor one or more body physical signs and/or penetration of the garment, and a process for making such a garment.

In the one-piece garment of the present invention, a single piece of fabric is cut and formed into a garment having minimal seams. Unlike the structure of a conventional garment made of fabric (woven, knitted or nonwoven), where several pieces of fabric need to be sewn together to make a "one-piece" garment, the present invention provides that a single piece of fabric may be cut, folded and sewn to form a "one-piece" garment, optionally having sleeves. Because of the ease of this process, garments can be fashioned out of two-dimensional woven, knitted or nonwoven fabrics with minimal cutting and sewing.

The present invention is directed to a process for producing a one-piece garment from a single piece of two-dimensional fabric comprising forming the fabric into a shape having (1) a mid-panel with a first side edge and a second side edge opposite thereto, and a first end edge and a second end edge opposite thereto, (2) an end panel attached to said second end edge at approximately the midpoint of the end edge and extending beyond the first side edge, and (3) a second end panel attached to said first end edge at approximately the midpoint of the end edge and extending beyond the second side edge. The fabric is then formed into a one-piece garment by folding the cut fabric along a first horizontal fold line located at the midpoint of the mid-panel, cutting the fabric at approximately the midpoint of the first horizontal fold line of the mid-panel, resulting in a hole big enough to accommodate a subject's head, folding the cut fabric along a first vertical fold line of the first end panel, wherein the fold is located at the second side edge of the mid-panel, folding the cut fabric along a second vertical fold line of the second end panel, wherein the fold is located at the first side edge of the mid-panel, and securing the resulting met edges of the fabric.

In the process of the present invention, a single piece of fabric can easily be converted into an overall or other full-body garment, similar to a hospital gown, with a top and legs using a minimum number of joins/seams. The present invention consists of a two-dimensional fabric with the various parts of the overall produced as a single piece. The process of the present invention can be modified to produce a garment with sleeves.

In a further embodiment, the one-piece garment made in accordance with the present invention may be fashioned into a garment having intelligence capacity. The garment can be provided with means for monitoring one or more body vital signs, such as blood pressure, heart rate, and temperature, as well as for monitoring garment penetration. The one-piece structure, which can be produced either with or without sleeves, allows for monitoring of vital signs of a patient, including monitoring of vital signs under a patient's arm.

The intelligent one-piece garment consists of a base fabric ("comfort component"), and at least one sensing component forming an information infrastructure. The sensing component can be either a penetration sensing material component or an electrical conductive material component, or both. The preferred penetration sensing component is plastic optical fiber (POF). The preferred electrical conductive component is either a doped inorganic fiber with polyethylene, nylon or other insulating sheath, or a thin gauge metal wire with polyethylene sheath. Optionally, the fabric can include a form-fitting component, such as SPANDEX fiber, or a static dissipating component, such as NEGA-STAT, depending upon need and application. Each of these components can be incorporated into the full-fashioned weaving process disclosed in U.S. Ser. No. 09/157,607 and U.S. Ser. No. 09/273,175, each of which is incorporated by reference it its entirety as if fully set forth herein.

The sensing component can, among other things, serve one or both of the following two main functions: (i) it can help detect projectile penetration; and (ii) it can serve as a "data bus" or "motherboard" for transferring information or data to and from other devices that are in communication with it. These capabilities can be used together or individually. The electrically conducting fibers can help carry information from sensors (mounted on the human/animal body or incorporated into the fabric structure) to monitoring devices to monitor heart rate, breathing rate, voice and/or any other desired body physical property. Thus, the present invention will create a flexible, one-piece garment, with or without sleeves, having a wearable information infrastructure that will facilitate the "plugging" in of devices for gathering/processing information concerning its wearer. Instead of both POF and conducting fibers, the fabric or garment can incorporate just conducting fibers and not the POF, or vice versa, depending on the desired end-use application. The number, length and pitch (thread spacing) of the POF can be varied to suit the desired end-use requirement. Similarly, the number, length and pitch (thread spacing) of the conducting fibers can be varied to suit the end-use requirement.

It can be seen from the description herein of our invention that a one-piece garment, with or without sleeves, can be formed from a single piece of two-dimensional fabric requiring minimal cutting and sewing, and by which a garment with intelligence capability can be made. These and other objects and advantages of the present invention will become apparent upon reading the following specification and claims in conjunction with the accompanying drawing figures.

BRIEF DESCRIPTION OF THE DRAWINGS

FIG. 6 illustrates the garment of FIG. 3 in the form of a printed elastic board.

DETAILED DESCRIPTION OF THE ILLUSTRATIVE EMBODIMENT

Figure 1:
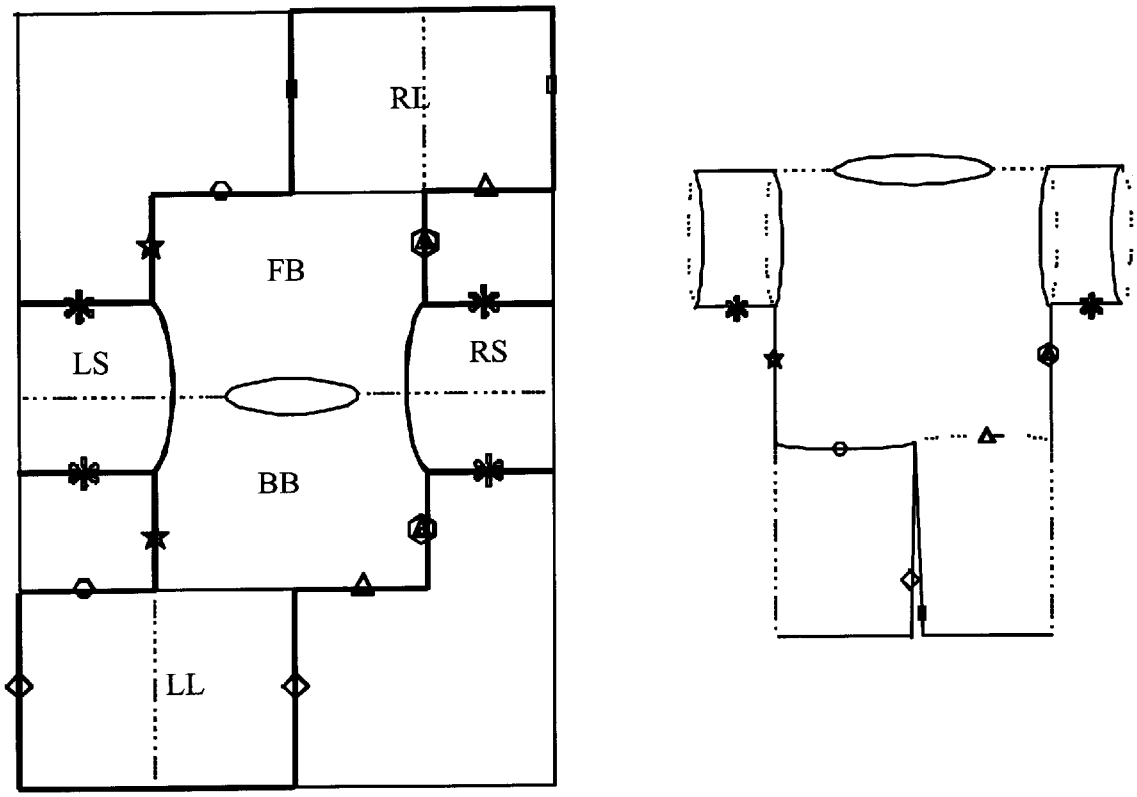
FIG. 1 illustrates the construction of a full-fashioned garment manufactured from a two-dimensional fabric.

Referring now to the above figures, wherein like reference numerals represent like parts throughout the several views, the full-fashioned weaving process and product of the present invention will be described in detail.

A. Method for Fashioning a Garment of the Present Invention

As illustrated in FIG. 1, a one-piece garment is manufactured from a single piece of two-dimensional fabric. By folding and cutting the fabric as illustrated, followed by securing where indicated, an "overall-type" garment results. The method of the present invention reduces the number of patterns to create multiple pieces of the garment, and thereby allows for minimal cutting and sewing.

The present invention provides for the manufacture of a garment from a single piece of fabric. In a garment which does not contain sleeves, the fabric is sectioned into three basic areas, as shown in FIG. 1. The first section, or mid-panel section, is generally the largest and comprises what results in the front (FB) and back body (BB) of the garment. The front and back sections are separated at a mid-point horizontal fold, which fold is cut to accommodate a hole for the head and neck. The mid-panel section has a first side edge, a second side edge, a first end edge and a second end edge. Offset from the main section are end sections which represent the right (RL) and left legs (LL) of the garment. The first end panel, having side edges, is connected to the first end edge of the mid-panel at approximately the midpoint and extends beyond the second side edge of the mid-panel. The second end panel, having side edges, is connected to the second end edge of the mid-panel and extends beyond the first side edge. Each end panel is folded vertically along a fold line extending from the side edge of the mid-panel, causing the side edges of each end panels to meet. The side edges are secured using any securing means, including sewing, gluing, taping, snaps and VELCRO.

When the garment of the present invention includes sleeves, as shown in FIG. 1, two additional sections (LS) and (RS) are provided, extending from the mid-panel along the middle horizontal fold. Upon folding the mid-panel horizontally, these additional sections are stitched to form sleeves.

Any type of two-dimensional fabric may be used to fashion the garment of the present invention, including woven, non-woven and knitted fabrics. Cotton, wool, polyesters, and other conventional fabrics, or blends thereof are particularly useful in the present invention. The choice of material for the yarn will ordinarily be determined by the end use of the fabric and will be based on a review of the comfort, fit, fabric hand, air permeability, moisture absorption and structural characteristics of the yarn. Suitable yarns included, but are not limited to, cotton, polyester/cotton blends, microdenier polyester/cotton blends and polypropylene fibers such as MERAKLON (made by Dawtex Industries).

B. Method for Producing the Fabric with Integrated Garment Parts

Figure 2:
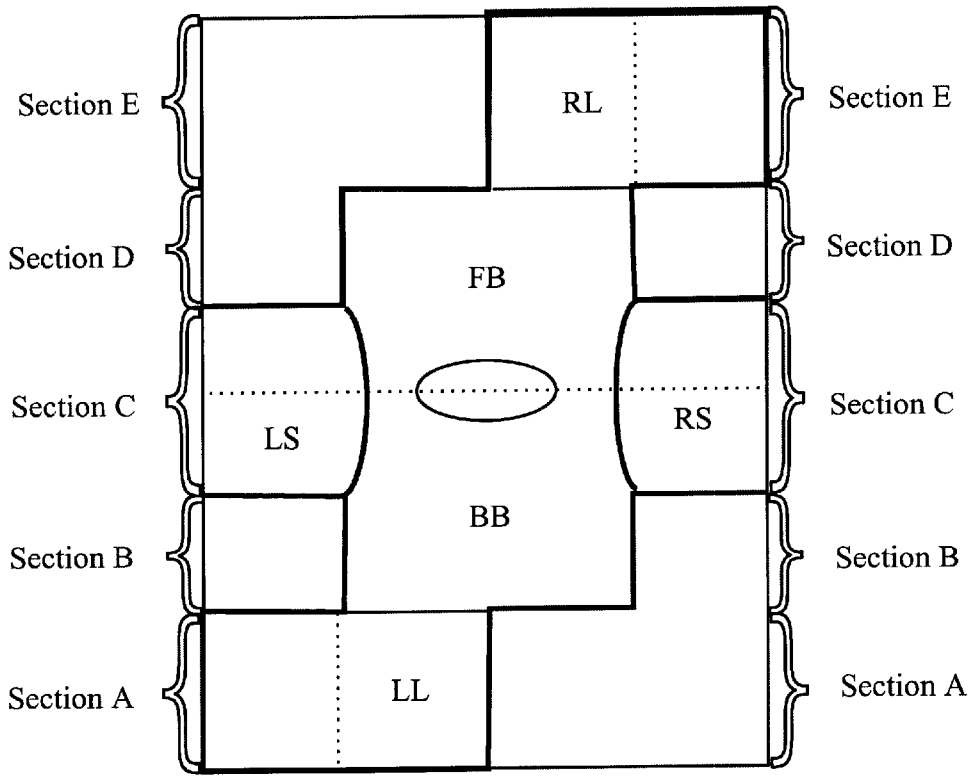
FIG. 2 illustrates the layout of the various parts comprising the one-piece garment, shown optionally with sleeves, in a single two-dimensional fabric.
Figure 3:
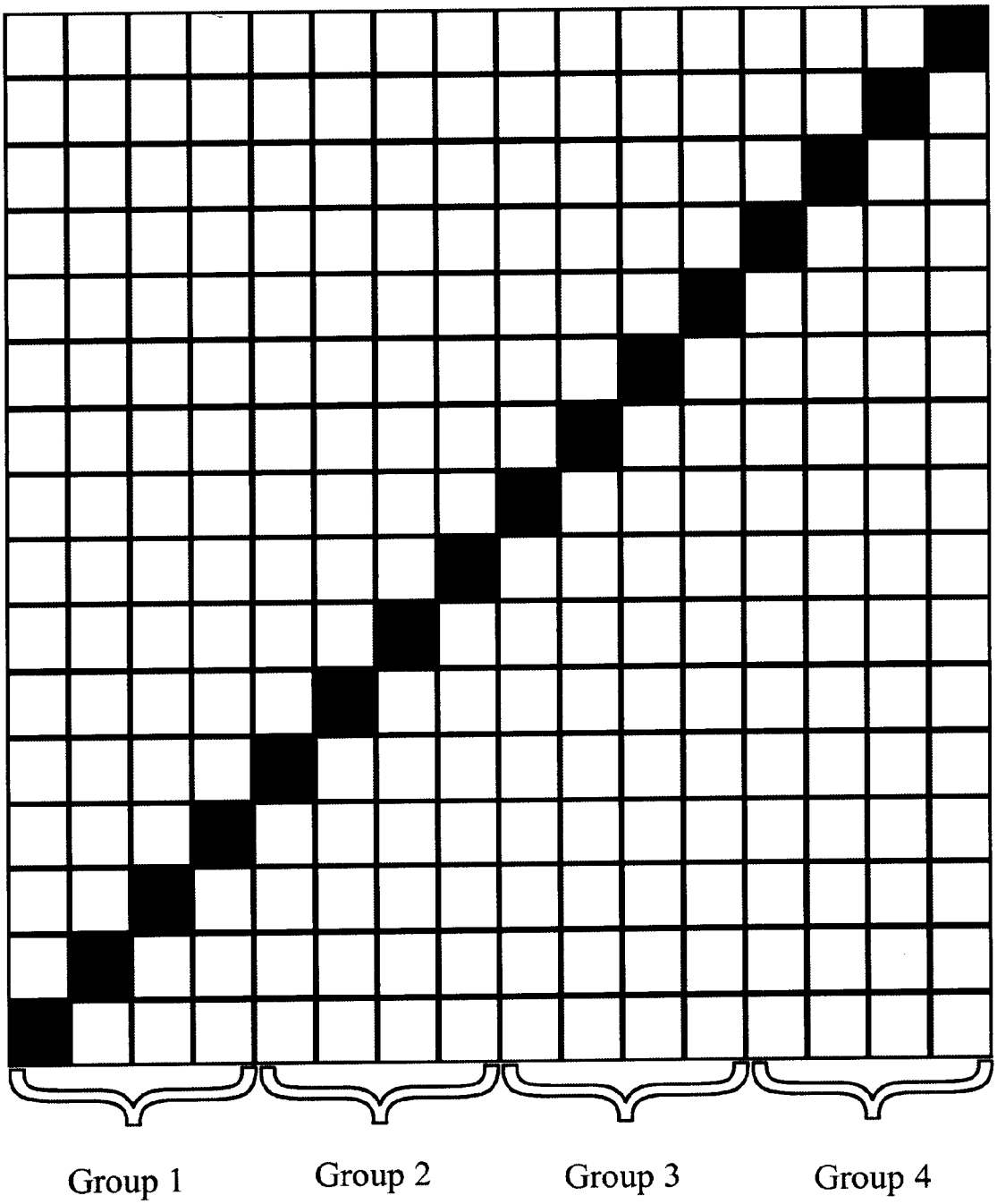
FIG. 3 illustrates the drawing-in draft of the garment of FIG. 2.

FIG. 2 shows the layout of the various parts of the garment that are produced on a weaving machine as a single two-dimensional fabric. FIG. 3 shows the drawing-in draft for the structure shown in FIG. 2.

Figure 4:
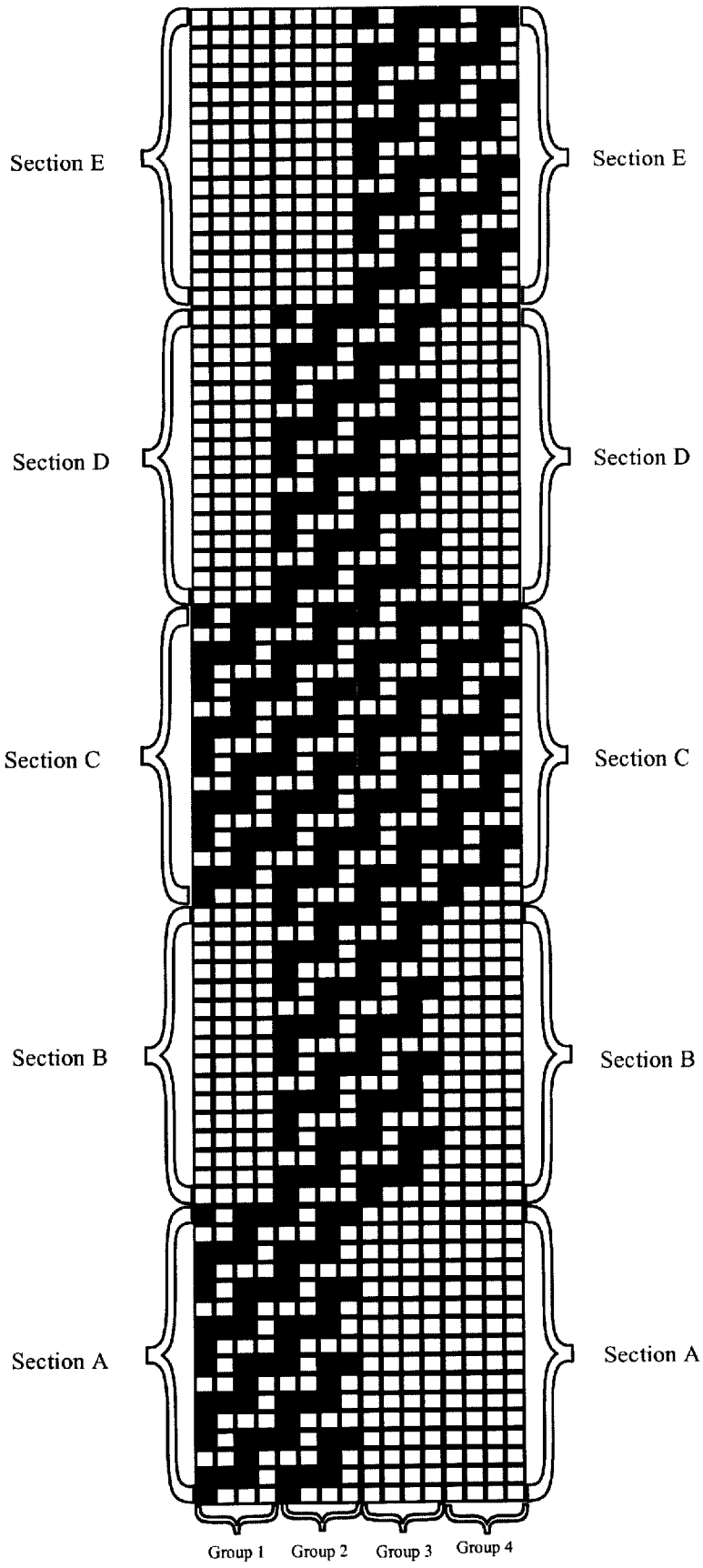
FIG. 4 illustrates the lifting plan of the garment of FIG. 2.

Section A of the fabric in FIG. 2 is created by the lifting sequence of the warp threads (also denoted as Section A) in FIG. 4. Thus, the four blocks (marked as Group 1, Group 2, Group 3 and Group 4 in FIG. 4) of warp threads together produce Section A of the fabric in FIG. 2. This results in the production of the left leg (LL) of the garment shown in FIG. 2. The lifting sequence shown in Section B in FIG. 4 is responsible for producing part of the back body (BB) of the garment; the lifting sequence shown as Section C in FIG. 4 results in the production of the remainder of the back body (BB) and part of the front body (FB) along with the sleeves (LS and RS) in FIG. 2. Then, the lifting sequence shown as Section D in FIG. 4 results in the production of the remainder of the front body (FB) in FIG. 2. Finally, the lifting sequence shown as Section E in FIG. 4 results in the production of the right leg (RL) in FIG. 4. Thus, using the combination of the drawing-in draft shown in FIG. 3 and the lifting sequence in FIG. 4, a two-dimensional fabric with integrated garment parts for creating an overall garment (with sleeves in the present example) can be produced on a loom.

The various parts (FB, BB, LL, RL, RS and LS) of the garment in the resulting fabric from this weaving process can be folded and secured by any securing means, including but not limited to sewing, snaps, glue or VELCRO, as shown in FIG. 1 to create a garment, optionally having sleeves.

1. Woven Fabric

Where a woven fabric is used, the base structure of the fabric preferably is a plain weave (other weaves, however, can be used depending on the application). As shown in FIG. 4, the warping sequence on the weaving machine (loom) is set for a "block weave" so that the desired groups of yarns can be dropped when necessary. One feature of this design is that the filling can be inserted continuously without any breakages.

A loom that permits the production of such a woven garment is the AVL Compu-Dobby, a shuttle loom that can be operated both in manual and automatic modes. It can also be interfaced with computers so that designs created using design software can be downloaded directly into the shed control mechanism. Alternatively, a jacquard loom may also be used. Since a dobby loom has been used, the production of the woven fabric on such a loom will be described. One loom configuration for producing the woven garment is:

| Parameter | Details |
|---|---|
| Loom Model | AVL Industrial Dobby Loom |
| Loom Description | Computer Controlled Dobby |
| Width | 60 Inches |
| Number of Harnesses | 24 |
| Dents/Inch | 10 |
| Take-Up Mechanism | Automatic Cloth Storage System |

It will be apparent to one skilled in the art that production of the woven garment in accordance with our present invention is not limited to using a weaving loom having 24 harnesses. For example, a 48 harness loom or a 400 hook jacquard loom machine can also be used.

2. Knitted Fabric

The following parameters are offered as one example of the use of knitted fabric in the garment of the present invention.

| Parameter | Details |
|---|---|
| Knitting Machine | Flat Bed (Hand Operated) |
| Description | 1 × 1 Rib |

-continued

| Parameter | Details |
|---|---|
| Gauge (Needles Per Inch) | 5 |
| Width | 40 Inches |
| Plastic Optical Fiber | PGU-CD-501-10-E from Toray Industries, New York. |
| Electrical Conductive Fiber | X-Static Conducting Nylon fiber with insulated PVC Sheath from Squat Industries, Pennsylvania |
| MERAKLON | 2/18s Ne Yarn from Dawtex, Inc., Canada |

The above table shows the parameters used for producing the knitted fabric embodiment of our present invention having an information infrastructure integrated within the fabric. In the example provided above, a plastic optical fiber is incorporated into the knitted fabric along with an electrical conductive fiber.

C. Intelligence Capability in Accordance With the Present Invention

Figure 5:
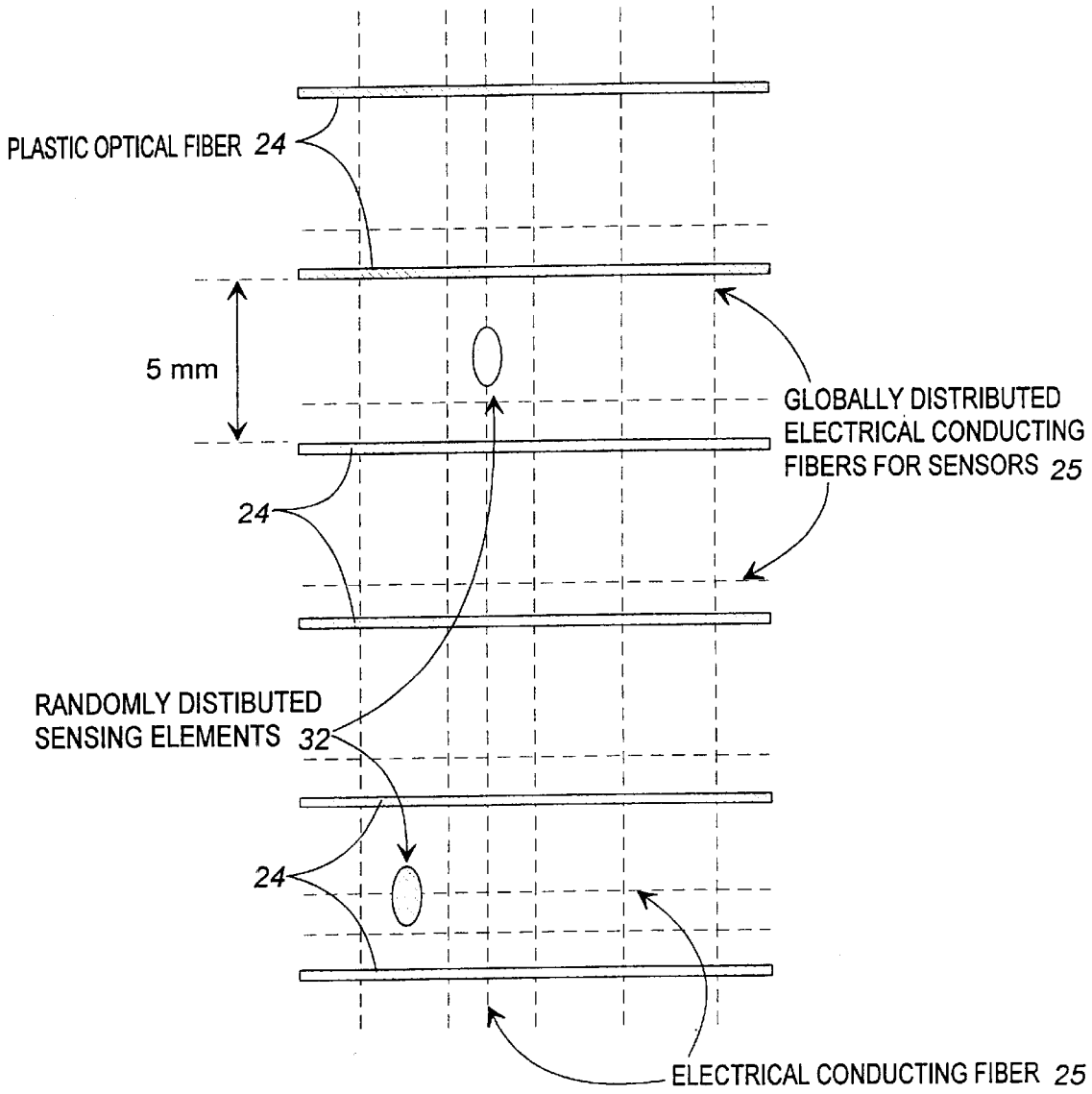
FIG. 5 illustrates a the sensor interconnection for the garment of FIG. 2.

In addition to the advantage of minimizing cutting and sewing, the fabric and process of the present invention may provide the basis for a garment, with or without sleeves, with intelligence capability, as illustrated in FIGS. 3–5. As such, the garment can be provided with means for monitoring body physical signs, such as blood pressure, heart rate, pulse and temperature, as well as for monitoring garment penetration. A garment with such intelligence capability consists of the following components: the base of the fabric or "comfort component," and an information infrastructure component. Additionally, a form-fitting component and a static dissipating component may be included, if desired.

The information infrastructure component can include any or all of the following, individually or in any combination: penetration detection components, electrically conductive components, sensors, processors, or wireless transmission devices. The information infrastructure component is capable of acquiring, processing and transmitting information from the subject to a local or remote monitoring unit.

The sensing component of the garment can include materials for sensing penetration of the garment, or one or more body physical signs, or both. These materials are woven or knitted during the weaving or knitting of the comfort component of the fabric. After fashioning of the garment is completed, these materials can be connected to a monitor (referred to as a "personal status monitor" or "PSM") which will take readings from the sensing materials, monitor the readings and issue an alert depending upon the readings and desired settings for the monitor, as described in more detail below.

Materials suitable for providing the penetration sensing and alert component 24 include: silica-based optical fibers, plastic optical fibers, and silicone rubber optical fibers. Suitable optical fibers include those having a filler medium which have a bandwidth which can support the desired signal to be transmitted and required data streams. Silica-based optical fibers have been designed for use in high bandwidth, long-distance applications. Their extremely small silica core and low numerical aperture (NA) provide a large bandwidth (up to 500 mhz*km) and low attenuation (as low as 0.5 dB/km). However, such fibers are not preferred because of high labor costs of installation and the danger of splintering of the fibers.

Plastic optical fibers (POF) 24 provide many of the same advantages that glass (silica-based) fibers do, but at a lower weight and cost. In certain fiber applications, as in some sensors and medical applications, the fiber length used is so short (less than a few meters) that the fiber loss and fiber dispersion are of no concern. Instead, good optical transparency, adequate mechanical strength, and flexibility are the required properties and plastic or polymer fibers are preferred. Moreover, plastic optical fibers do not splinter like glass fibers and, thus, can be more safely used in the liner than glass fibers.

For relatively short lengths, POFs have several inherent advantages over glass fibers. POFs exhibit relatively higher numerical aperture (NA), which contributes to their capability to deliver more power. In addition, the higher NA lowers the POF's susceptibility to light loss caused by bending and flexing of the fiber. Transmission in the visible wavelengths range is relatively higher than anywhere else in the spectra. This is an advantage since in most medical sensors the transducers are actuated by wavelengths in the visible range of the optical spectra. Because of the nature of its optical transmission, POF offers similar high bandwidth capability and the same electromagnetic immunity as glass fiber. In addition to being relatively inexpensive, POF can be terminated using a hot plate procedure which melts back the excess fiber to an optical quality end finish. This simple termination combined with the snap-lock design of the POF connection system, which connection system can be a conventional connection system, allows for the termination of a node in under a minute. This translates into extremely low installation costs. Further, POFs can withstand a rougher mechanical treatment displayed in relatively unfriendly environments. Applications demanding inexpensive and durable optical fibers for conducting visible wavelengths over short distances are currently dominated by POFs made of either poly-methyl-methacrylate (PMMA) or styrene-based polymers.

Silicone rubber optical fibers (SROF), a third class of optical fibers, provide excellent bending properties and elastic recovery. However, they are relatively thick (of the order of 5 mm) and suffer from a high degree of signal attenuation. Also, they are affected by high humidity and are not yet commercially available. Hence, although these fibers are not preferred for use in the woven or knitted fabric, they can be used. Those fibers can be obtained from Oak Ridge National Lab, Oak Ridge, Tenn.

To incorporate a penetration sensing component material into the woven or knitted fabric, the material, preferably plastic optical fiber (POF) 24, is spirally integrated into the structure during the full-fashioned weaving or knitting fabric production process. The POF does not terminate in the middle of the fabric and continues throughout the fabric without any discontinuities. This results in only one single integrated fabric and no seams insofar as the POF is concerned. The preferred plastic optical fiber is from Toray Industries, New York, in particular product PGS-GB 250 optical fiber cord from Toray Industries.

Alternatively, or additionally, the sensing component may consist of an electrical conducting material component (ECC) 25. The electrical conductive fiber preferably has a resistivity of from about $0.07\times10^{-3}$ to 10 Kohms/cm. The ECC 25 can be used to monitor one or more body vital signs including heart rate, pulse rate, temperature and blood pressure through sensors on the body and for linking to a personal status monitor (PSM). Suitable materials include, but are not limited to, the three classes of intrinsically conducting polymers described below, doped inorganic fibers and metallic fibers.

Polymers that conduct electric currents without the addition of conductive (inorganic) substances are known as "intrinsically conductive polymers" (ICP). Electrically conducting polymers have a conjugated structure, i.e., alternating single and double bonds between the carbon atoms of the main chain. In the late 1970s, it was discovered that polyacetylene could be prepared in a form with a high electrical conductivity, and that the conductivity could be further increased by chemical oxidation. Thereafter, many other polymers with a conjugated (alternating single and double bonds) carbon main chain have shown the same behavior., e.g., polythiophene and polypyrrole. In the beginning, it was believed that the processability of traditional polymers and the discovered electrical conductivity could be combined. However, it has been found that the conductive polymers are rather unstable in air, have poor mechanical properties and cannot be easily processed. Also, all intrinsically conductive polymers are insoluble in any solvent, and they possess no melting point or other softening behavior. Consequently, they cannot be processed in the same way as normal thermoplastic polymers and are usually processed using a variety of dispersion methods. Because of these shortcomings, fibers made up of fully conducting polymers with good mechanical properties are not yet commercially available and hence are not presently preferred for use in the present invention, although they can be used.

Yet another class of conducting fibers consists of those that are doped with inorganic or metallic particles. The conductivity of these fibers is quite high if they are sufficiently doped with metal particles, but this would make the fibers less flexible. Such fibers can be used to carry information from the sensors to the monitoring unit if they are properly insulated.

Metallic fibers, such as copper and stainless steel insulated with polyethylene or polyvinyl chloride, can also be used as the conducting fibers in the woven or knitted fabric. With their exceptional current carrying capacity, copper and stainless steel are more efficient than any doped polymeric fibers. Also, metallic fibers are strong; they resist stretching, neck-down, creep, nicks and breakage very well. Therefore, metallic fibers of very small diameter (of the order of 0.1 mm) will be sufficient to carry information from the sensors to the monitoring unit. Even with insulation, the fiber diameter will be less that 0.3 mm and hence these fibers will be very flexible and can be easily incorporated into the woven or knitted fabric. Also, the installation and connection of metallic fibers to the PSM unit will be simple and there will be no need for special connectors, tools, compounds and procedures.

One example of a high conductive yarn suitable for this purpose is Bekinox available from Bekaert Corporation, Marietta, Ga., a subsidiary of Bekintex NV, Wetteren, Belgium, which is made up of stainless steel fibers and has a resistivity of 60 ohm-meter. The bending rigidity of this yarn is comparable to that of the polyamide high-resistance yarns and can be easily incorporated into the data bus in our present invention.

Thus, the preferred electrical conducting materials for the sensing component for the garment of the present invention are: (i) doped inorganic fibers with polyethylene, nylon or other insulating sheath; (ii) insulated stainless steel fibers; and (iii) thin copper wires with polyethylene sheath. All of these fibers can readily be incorporated into the garment and can serve as elements of an elastic printed circuit board, described below. An example of an available doped inorganic fiber is X-Static coated nylon (T66) from Sauquoit Industries, South Carolina. An example of an available thin copper wire is 24 gauge insulated copper wire from Ack Electronics, Atlanta, Ga.

The electrical conducting component fibers can be incorporated into the woven or knitted fabric in two ways: (a)

regularly spaced yarns acting as sensing elements; and (b) precisely positioned yarns for carrying signals from the sensors to the PSM. They can be distributed both in the warp and filling directions in the woven fabric.

The form-fitting component (FFC) 26 provides form-fit to the wearer, if desired. More importantly, it keeps the sensors in place on the wearer's body during movement. Therefore, the material chosen should have a high degree of stretch to provide the required form-fit and at the same time, be compatible with the material chosen for the other components of the garment. Any fiber meeting these requirements is suitable. The preferred form-fitting component is SPANDEX fiber, a block polymer with urethane groups. Its elongation at break ranges from 500 to 600% and, thus, can provide the necessary form-fit to the garment. Its elastic recovery is also extremely high (99% recovery from 2–5% stretch) and its strength is in the 0.6–0.9 grains/denier range. It is resistant to chemicals and withstands repeated machine washings and the action of perspiration. It is available in a range of linear densities.

The purpose of the static dissipating component (SDC) 28 is to quickly dissipate any built-up static charge during the usage of the intelligent garment. Such a component may not always be necessary. However, under certain conditions, several thousand volts may be generated which could damage the sensitive electronic components in the PSM unit. Therefore, the material chosen must provide adequate electrostatic discharge protection (ESD) protection in the woven or knitted fabric.

NEGA-STAT, a bicomponent fiber produced by DuPont is the preferred material for the static dissipating component (SDC). It has a trilobal shaped conductive core that is sheathed by either polyester or nylon. This unique trilobal conductive core neutralizes the surface charge on the base material by induction and dissipates the charge by air ionization and conduction. The nonconductive polyester or nylon surface of NEGA-STAT fiber controls the release of surface charges from the thread to provide effective static control of material in the grounded or ungrounded applications according to specific end-use requirements. The outer shell of polyester or nylon ensures effective wear-life performance with high wash and wear durability and protection against acid and radiation. Other materials which can effectively dissipate static and yet function as a component of a wearable, washable garment may also be used.

With reference to FIG. 5, connectors, such as T-connectors (similar to the "button clips" used in clothing), can be used to connect the body sensors 32 to the conducting wires that go to the PSM. By modularizing the design of the garment of the present invention (using these connectors), the sensors themselves can be made independent of the garment. This accommodates different body shapes. The connector makes it relatively easy to attach the sensors to the wires. Yet another advantage of separating the sensors themselves from the garment, is that they need not be subjected to laundering when the garment is laundered, thereby minimizing any damage to them. However, it should be recognized that the sensors 32 can also be woven into the structure of a woven fabric.

The specification for the preferred materials to be used in the production of the intelligent garment of the present invention are as follows:

| Component | Materials | Count (CC) |
|---|---|---|
| Penetration Sensing (PSC) | Plastic Optical Fibers (POF) | 6s Ne Core-Spun from 12s Ne POF/sheathed from 12s Ne POF |
| Comfort (CC) | MERAKLON Microdenier Poly/Cotton Blend | 8s NE |
| Form-fitting (FFC) | Spandex | 8s Ne Core-Spun from 12s NE Spandex yarn |
| Global and Random Conducting (ECC) | Copper with polyethylene sheath, Doped inorganic fiber with sheath | 6s Ne |
| Static Dissipating (SDC) | Copper with polyethylene sheath, Doped inorganic fiber with sheath | 18s Ne |

The above yarn counts have been chosen based on initial experimentation using yarn sizes that are typically used in undergarments. Other yarn counts can be used. The weight of the fabric of this embodiment is around 10 oz/yd$^2$ or less. While the above materials are the preferred materials for use in the production of our garment, upon reading this specification it will be readily recognized that other materials may be used in place of these preferred materials and still provide a garment for sensate care in accordance with our present invention.

D. Intelligence Capability of the Garment

The operation of the garment assembly to illustrate its penetration alert and vital signs monitoring capabilities are now discussed.

Penetration Alert:

1. Precisely timed pulses are sent through the POF integrated into the garment.
2. If there is no rupture of the POF, the signal pulses are received by a receiver and an "acknowledgment" is sent to the PSM unit indicating that there is no penetration.
3. If the optical fibers are ruptured at any point due to penetration, the signal pulses bounce back to the first transmitter from the point of impact, i.e., the rupture point. The time elapsed between the transmission and acknowledgment of the signal pulse indicates the length over which the signal has traveled until it reached the rupture point, thus identifying the exact point of penetration.
4. The PSM unit transmits a penetration alert via a transmitter specifying the location of the penetration.

Physical Signs Monitoring:

1. The signals from the sensors are sent to the PSM unit through the electrical conducting component (ECC) of the garment.
2. If the signals from the sensors are within the normal range and if the PSM unit has not received a penetration alert, the physical sign readings are recorded by the PSM unit for later processing.
3. However, if the readings deviate from the normal, or if the PSM unit has received a penetration alert, the physical sign readings are transmitted using the transmitter.

Thus, the proposed intelligent garment is easy to deploy and meets all the functional requirements for monitoring body physical signs and/or penetration. The detection of the location of the actual penetration in the POF can be determined by an Optical Time Domain Reflectometer.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A process for producing a one-piece garment from a single piece of two-dimensional fabric comprising:

(a) forming the fabric into a shape having (1) a mid-panel with a first side edge and a second side edge opposite thereto, and a first end edge and a second end edge opposite thereto, (2) an end panel attached to said second end edge at approximately the midpoint of the end edge and extending beyond the first side edge, and (3) a second end panel attached to said first end edge at approximately the midpoint of the end edge and extending beyond the second side edge;

(b) folding the cut fabric along a first horizontal fold line located at the midpoint of the mid-panel;

(c) cutting the fabric at approximately the midpoint of the first horizontal fold line of the mid-panel, resulting in a hole big enough to accommodate a subject's head;

(d) folding the cut fabric along a first vertical fold line of the first end panel, wherein the fold is located at the second side edge of the mid-panel;

(e) folding the cut fabric along a second vertical fold line of the second end panel, wherein the fold is located at the first side edge of the mid-panel;

(f) securing the resulting met edges of the fabric.

2. The process of claim 1, wherein the met edges of the fabric are secured with stitches, snaps, a hook and loop-type fastener, or glue.

3. The process of claim 1, wherein step (a) further comprises;

(a)(i) forming the fabric into a shape having a first side panel, said first side panel having a top edge and a bottom edge opposite thereto, which side panel is attached to the mid-panel at approximately the mid-point of the first side edge, and a second side panel, said second side panel having a top edge and a bottom edge opposite thereto, attached to the mid-point of the mid-panel at approximately the second side edge;

(a)(ii) folding the fabric of step (a)(i) along a first horizontal fold line, wherein the top edge of the first side panel meets with the bottom edge of the first side panel and the top edge of the second side panel meets with the bottom edge of the second side panel; and (a)(iii) securing the resulting met edges of the fabric.

4. The process of claim 3, wherein the met edges are secured with stitches, snaps, a hook and loop-type fastener, or glue.

5. A garment with legs, wherein the garment is fashioned from a fabric comprised of (a) a comfort component and (b) an integrated information infrastructure component, wherein the information infrastructure component is selected from the group consisting of, individually or in any combination, penetration detection components, sensors, processors, wireless transmission devices, and electrically conductive components, said electrically conductive components comprising one or more individually insulated conductive fibers.

6. A garment with legs and sleeves, wherein the garment is fashioned from a fabric comprised of (a) a comfort component and (b) an integrated information infrastructure component, wherein the information infrastructure component is selected from the group consisting of, individually or in any combination, penertration detection components, sensors, processors, wireless transmission devices, and electrically conductive components, said electrically conductive components comprising one or more individually insulated conductive fibers.

7. A process for producing a one-piece garment with legs, and optionally with sleeves, comprising:

(a) weaving a fabric into a shape having (1) a mid-panel with a first side edge and a second side edge opposite thereto, and a first end edge and a second end edge opposite thereto, (2) an end panel attached to said second end edge at approximately the midpoint of the end edge and extending beyond the first side edge, and (3) a second end panel attached to said first end edge at approximately the midpoint of the end edge and extending beyond the second side edge; and optionally (4) a first side panel, having a top edge and a bottom edge, which first side panel is attached to the mid-panel at approximately the mid-point of the first side edge and a second side panel, having a top edge and a bottom edge, which second side panel is attached to the mid-point of the mid-panel at approximately the second side edge;

(b) cutting the warp threads that are not woven into the fabric;

(c) folding the cut fabric along a first horizontal fold line located at the midpoint of the mid-panel;

(d) cutting the fabric at approximately the midpoint of the first horizontal fold line of the mid-panel, resulting in a hole big enough to accommodate a subject's head;

(e) folding the cut fabric along a first vertical fold line of the first end panel, wherein the fold is located at the second side edge of the mid-panel;

(f) folding the cut fabric along a second vertical fold line of the second end panel, wherein the fold is located at the first side edge of the mid-panel;

(g) optionally, folding the fabric along the first horizontal fold line such that the top edge of the first side panel meets with the bottom edge of the first side panel and the top edge of the second side panel meets with the bottom edge of the second side panel; and (h) securing the resulting met edges of the fabric.

8. the process of claim 7, wherein the fabric is woven from:

a. a comfort component and b. an integrated information infrastructure component, wherein the information infrastructure component is selected from the group consisting of, individually or in any combination, penetration detection components, sensors, processors, wireless transmission devices, and electrically conductive components, said electrically conductive components comprising one or more individually insulated conductive fibers.

9. The process of claim 1, wherein the two-dimensional fabric comprises:

a. a comfort component; and b. an integrated information infrastructure component, wherein the information infrastructure component is selected from the group consisting of, individually or in any combination, penetration detection components, sensors, processors, wireless transmission devices, and electrically conductive components, said electrically conductive components comprising one or more individually insulated conductive fibers.

10. The process of claim 3, wherein the two-dimensional fabric comprises:

a. a comfort component; and b. an integrated information infrastructure component, wherein the information infrastructure component is selected from the group consisting of, individually or in any combination, penetration detection components, sensors, processors, wireless transmission devices, and electrically conductive components, said electrically conductive components comprising one or more individually insulated conductive fibers.

* * * * *